US005272457A

United States Patent [19]

Heckaman et al.

[11] Patent Number: 5,272,457

[45] Date of Patent: Dec. 21, 1993

[54] HIGH ISOLATION INTEGRATED SWITCH CIRCUIT

[75] Inventors: Douglas Heckaman, Indialantic; Augusto E. Rodriguez, Miami Beach, both of Fla.; Jerry Schappacher, Portland, Oreg.

[73] Assignee: Harris Corporation, Melbourne, Fla.

[21] Appl. No.: 849,170

[22] Filed: Mar. 10, 1992

[51] Int. Cl.[5] ..... H01P 1/15

[52] U.S. Cl. ..... 333/262; 307/242; 307/571; 333/104

[58] Field of Search ..... 333/101, 103, 106, 161, 333/164, 262; 307/242, 571, 574, 304

[56] References Cited

U.S. PATENT DOCUMENTS

| | | | |
|---|---|---|---|
| 3,017,585 | 1/1962 | Luke | 333/103 |
| 3,551,707 | 12/1970 | Seitzer | 333/103 X |
| 3,736,534 | 5/1973 | Chaffee . | |
| 3,982,212 | 9/1976 | Wallington et al. . | |
| 4,267,538 | 5/1981 | Assal et al. | 333/262 |
| 4,313,095 | 1/1982 | Jean-Frederic | 333/116 |
| 4,556,808 | 12/1985 | Coats | 307/571 |
| 4,626,806 | 12/1986 | Rosar et al. | 333/104 |
| 4,719,374 | 1/1988 | Bialo | 307/571 |
| 4,787,686 | 11/1988 | Tajima et al. | 307/568 |
| 4,837,530 | 6/1989 | Kondoh | 333/81 A |
| 4,996,504 | 2/1991 | Huber et al. | 333/81 R |
| 5,148,062 | 9/1992 | Goldfarb | 333/164 X |
| 5,159,297 | 10/1992 | Tateno | 333/104 |

FOREIGN PATENT DOCUMENTS

| | | | |
|---|---|---|---|
| 219301 | 8/1990 | Japan | 333/103 |

OTHER PUBLICATIONS

Matthaei, Young & Jones; "Microwave Filters, Impedance-Matching Networks, and Coupling Structures", Artech House, Inc., 1964; pp. 497-519.

"DC-24 GHz Chip Attenuator"; *Microwave Journal*, Mar., 1990, pp. 164-166.

GaAs SPDT Switch Chip DC-6 GHz, Model SW-200, by Adams Russell—ANZAC Division—specifications and characteristics.

*Primary Examiner*—Paul Gensler

*Attorney, Agent, or Firm*—Charles E. Wands

[57] ABSTRACT

A high isolation broadband switching circuit includes a plurality of switching elements coupled in series alternatingly with transmission line segments. Each switching element has a low or very high impedance between first and second points responsive to first and second values of a control voltage, respectively. In a first embodiment, the switching element includes a PIN diode having a cathode coupled to a first transmission line and an anode coupled to a second transmission line. In a second embodiment, the switching element includes a field effect transistor (FET) having a drain coupled to a first transmission line and a source coupled to a second transmission line. A first resistor is coupled between the drain and the source for DC continuity between the drain and the source, and a second resistor coupled between a gate of the FET and ground for DC continuity. A bias voltage source is coupled through a resistor to one of a source and a drain of one of the FETs. A bias voltage propagates through each transmission line and each first resistor, so DC continuity is provided. The bias voltage has a first value which causes the switching elements to have a low impedance to place the switching circuit in an ON state, and a second value which causes the switching elements to have a high impedance to place the circuit in a non-conductive state. The high impedance of the switching elements effectively opens the connections between the transmission lines.

14 Claims, 9 Drawing Sheets

HIGH ISOLATION INTEGRATED SWITCH CIRCUIT

FIELD OF THE INVENTION

The present invention generally relates to the field of semiconductor switching devices, and more particularly relates to a broadband high isolation switching device having a compact layout and high isolation characteristics.

BACKGROUND OF THE INVENTION

In the field of high isolation broadband switching matrices, MMIC (microwave monolithic integrated circuit) type switches have been employed. Many high frequency switching circuits are analogous to electromechanical switching devices. The circuits have OFF and ON states which correspond to open and closed states of conventional switches, respectively. In the ON state, a switching circuit provides a low impedance pathway between an input and an output to facilitate propagation of a high frequency signal, e.g., a radio frequency (RF) signal. On the other hand, an OFF state opens the pathway to provide a high impedance or high reactance barrier against propagation of the signal. The isolation of the circuit is a quantitative measure of the degree to which the switching circuit prevents propagation of the high frequency signal, and is customarily given in decibels (dB). The isolation in the OFF state should preferably be as great as possible.

For instance, FIGS. 1 and 2 respectively show conventional single pole, single throw (SPST) and single pole, double throw (SPDT) switching circuits. The circuits each employ semiconductor switching elements shown as field effect transistors (FETs). FETs are commonly employed as voltage controlled resistors in which gate voltages control drain/source resistance, or as voltage controlled current sources in which gate voltages control drain and source currents. The FETs are configured either in shunt (source coupled to ground, labeled as 2) or in series (both drain and source coupled to other circuit elements or to a circuit input or output, labeled as 4). In either case, input control signals are provided to the gates of the FETs.

If a plurality of such switching circuits are coupled together for greater isolation, then the same control lines are coupled to each circuit. Therein lies a problem which tends to reduce isolation. High frequency signals have a way of leaking through any paths available to them, due to factors such as inductive coupling. This coupling takes place even when the circuit configuration would appear, on its face, to isolate the signals from the paths. In the cases of FIGS. 1 and 2, the high frequency signals propagating through the drains and sources of the series FETs leak through the control lines from one circuit to another, effectively reducing the "OFF" isolation. This problem is made worse since the circuits require pluralities of control inputs, two in the case of the SPST circuit and four in the case of the SPDT circuit.

The circuits of FIGS. 1 and 2 have additional undesirable design constraints. First, the control voltages must be approximately 0 and −5 volts. Since these are not standard logic voltages, additional voltage translating circuitry must be provided. Second, the sources of the shunt FETs require a low impedance path to ground.

Preparing a physical layout for high isolation switches has presented a related problem. If the transmission lines of a distributed type high isolation switch are folded alongside each other, inductive and capacitive coupling will usually cause degraded isolation. On the other hand, if the transmission lines are laid end-to-end in a straight line, the physical layout is more difficult to fabricate and package, and the result is in an elongated layout which results in less compactness of layout and lower manufacturing yield than is desirable. Also, it is sometimes desirable to use adjacent transmission lines of the switching circuit together with reactive or resistive circuit elements to provide feedback. In an elongated layout, a conductive bridge between two desired points in the circuit will probably be long enough to introduce undesirable phase shifts, thereby making it difficult to provide bridges between desired points to achieve desired effects.

SUMMARY OF THE INVENTION

To overcome the problems discussed above, there is provided in accordance with the invention a high frequency switch circuit element comprising a field effect transistor having a gate, a drain, and a source, a first resistor coupled between the drain and the source for providing direct current (DC) continuity therebetween, and a second resistor coupled between the gate and ground.

There is further provided in accordance with the invention a high isolation integrated high frequency switch circuit module comprising a plurality of voltage controlled switch elements having ON and OFF states, wherein, when the switch elements are in the OFF state, the switch elements are non-conductive, and a plurality of transmission line segments respectively coupled in series between adjacent ones of the switch elements. The transmission line segments are aligned adjacent to each other, and are balanced about a central axis to form an all-stop filter structure when OFF. A control voltage having first and second values is applied to the switch elements. The switch elements enter the ON and OFF states responsive to the first and second values, respectively.

A switching circuit or switching device according to the invention is advantageous over the conventional circuits in that it eliminates the need for numerous control inputs which otherwise provides coupling due to high frequency leakage. Also, when the switching circuit is in the OFF mode, the signal path geometry is in an all-stop filter configuration which provides good isolation.

BRIEF DESCRIPTION OF THE DRAWINGS

The invention will be understood from the following detailed description, particularly with reference to the drawings, in which.

DETAILED DESCRIPTION OF THE PREFERRED EMBODIMENTS

Figure 3:
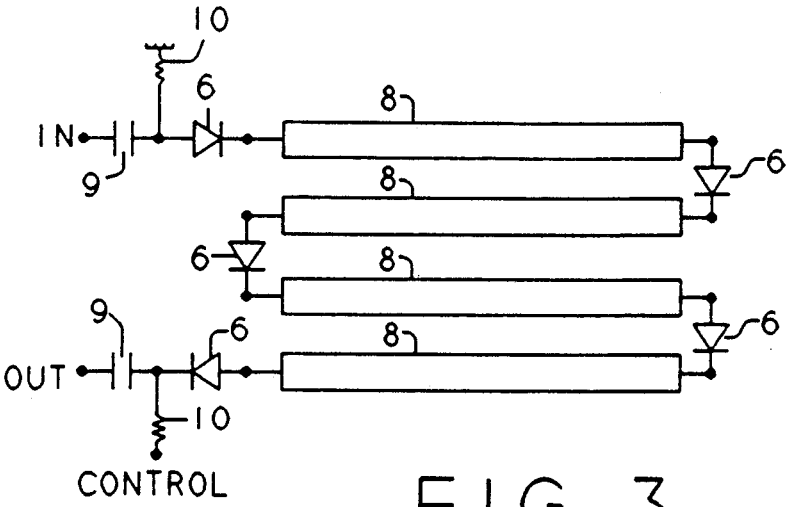
FIG. 3 is a schematic representation of a switching circuit according to a first embodiment of the invention.

FIG. 3 is a schematic diagram of a switching circuit according to a first embodiment of the invention. A switching circuit in accordance with the invention includes one or more switching elements having an ON, or conductive, state and an OFF, or non-conductive, state. In the case of the circuit of FIG. 3, PIN diodes 6 are used as the switching elements. The PIN diodes 6 are coupled in alternating series with transmission lines 8, which preferably are 50 Ohm characteristic impedance transmission lines.

Such a switching circuit has a bandwidth which depends on the number of PIN diodes 6 used and the Q of the PIN diodes 6. The Q is a parameter defined as the ratio of the impedance in the OFF state to the resistance in the ON state. A preferred length for the transmission lines 8 is approximately ¼ of a wavelength corresponding to a maximum frequency of the bandwidth.

Various types of ON-OFF switching elements may be used as alternatives to the PIN diodes 6. The switching elements preferably have less than 10 Ohms series resistance when ON and more than 200 Ohms of series capacitive reactance when OFF.

As shown in FIG. 3, semiconductor microwave switching devices have been implemented using the PIN (p-type, intrinsic, n-type) diode switching elements 6 and characteristic impedance transmission lines 8 coupled in series between the PIN diodes 6. The PIN diodes 6 and the transmission line segments 8 are coupled in alternating series between first and second bias voltage sources to form a circuit pathway from the first source to the second source. Each PIN diode has an anode directed toward the first source and a cathode directed toward the second source. Preferably, one of the sources is ground and the other is a control voltage which varies between an ON value which forward biases the PIN diodes and an OFF value which does not forward bias the PIN diodes.

Physically, the transmission line segments 8 are laid out side by side and parallel, so that the segments 8 are balanced about a central axis running through the segments 8. This physical layout provides advantageous isolation, as will be discussed below.

In operation, a negative control voltage causes a current to flow through resistors 10 and the series of PIN diodes 6 to become forward biased and achieve an "ON" state. A typical microwave silicon beam lead PIN diode will require approximately 0.01 Amp DC and a drop of 1.0 volts to reach a microwave series resistance of 2.0 Ohms. For very broad bandwidth operation, such as 0.2 to 20.0 GHz, resistive type bias decoupling is used. For instance, in FIG. 3, 500 Ohm decoupling resistors 10 are coupled in series with the two PIN diodes 6 adjacent to ground and the control input. In this configuration, in which two series 500 Ohm resistors carry 0.01 amps and each PIN diode 6 has a 1.0 volt forward bias drop, a total of 15 volts are required to forward bias the PIN diodes 6 ON.

High frequency signals coupled to a input of the circuit propagate through the PIN diodes 6 and the transmission line segments 8 to an output while the control voltage is high. Capacitors 9 coupled between the input and an anode of a first PIN diode 9, and between the output and a cathode of a last PIN diode 6, provide DC isolation between the circuit shown and other system components coupled to the input and output.

Figure 4:
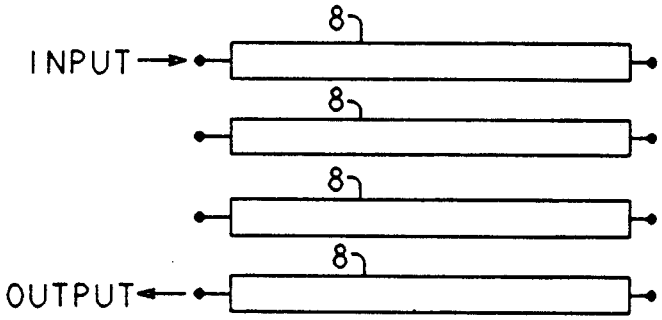
FIG. 4 is a schematic representation of the circuit of FIG. 3 in an OFF state.

On the other hand, when the control voltage is approximately equal to ground, the PIN diodes 6 are OFF, i.e., biased in a non-conductive state. The PIN diodes approximate open circuits, resulting in an all-stop configuration as shown in FIG. 4. The expression "all-stop" refers to the fact that in this transmission line geometry in which the transmission line segments 8 are balanced about a central axis, the inductive and capacitive characteristics of adjacent lines cancel out any coupling effect. Absent any transmission line coupling, the input-to-output isolation of the device is limited only by the OFF capacitance of the PIN diodes 6, the number of PIN diodes 6 in the circuit, and the normal constructive and destructive signal phasing caused by the long periodic transmission line.

Figure 1:
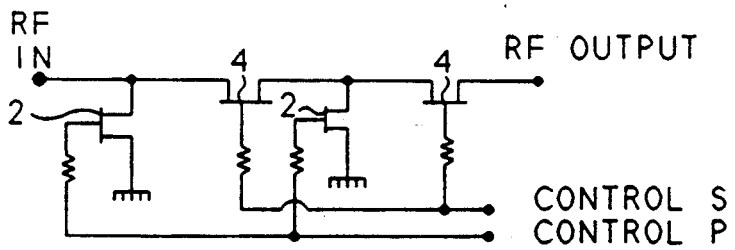
FIG. 1 (PRIOR ART)
FIG. 1 is a schematic diagram of a conventional single pole single throw switching circuit.
Figure 2:
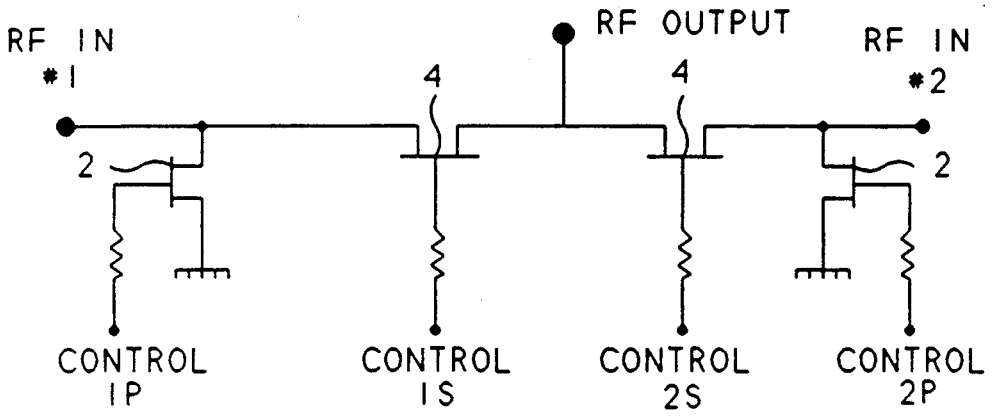
FIG. 2 (PRIOR ART)
FIG. 2 is a schematic diagram of a conventional single pole double throw switching circuit.

Switching devices using PIN diodes are advantageous in that they do not require as many control lines as the circuits of FIGS. 1 and 2 require. Thus, fewer high frequency leakage pathways are provided, and isolation is improved.

Figure 5:
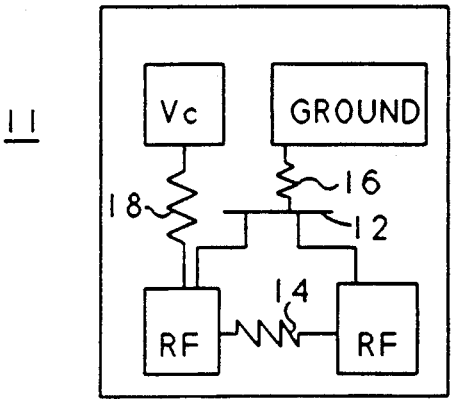
FIG. 5 is a schematic diagram of a switching element according to a second embodiment of the invention.

FIG. 5 is a schematic representation of a basic high frequency switching element 11 according to a second embodiment of the invention, in which a field effect transistor (FET) 12 is used in place of a PIN diode. The FET 12 has a drain and a source which are coupled together for DC continuity through a first resistor 14. The FET 12 also has a gate coupled to a predetermined voltage source, preferably ground, for DC continuity through a second resistor 16. Contact pads RF are provided for connections to the circuit. The first and second resistors 14 and 16 do not, as a rule, carry current. Rather, they provide high impedance pathways for voltage continuity between the drain and the source, and between the gate and ground. The resistors 14 and 16 have values which do not significantly disturb the OFF state isolation at the high end of the useful frequency range of the switching element. By establishing a finite, albeit non-zero, resistance between the drain and the source, the resistor 14 prevents small parasitic resistances within the semiconductor layout from producing a voltage drop between the drain and the source. Similarly, while not significantly shunting the RF signal to ground, resistor 16 maintains the gate of FET 12 at ground potential. This gate terminal is not perfectly isolated from the source and drain terminals at high frequencies due to the parasitic capacitances within the semiconductor junction of the FET. If the gate were isolated, then the resistor 16 could have a very low resistance value, or approximately 0 ohms, without disturbing the RF signal path.

Figure 6:
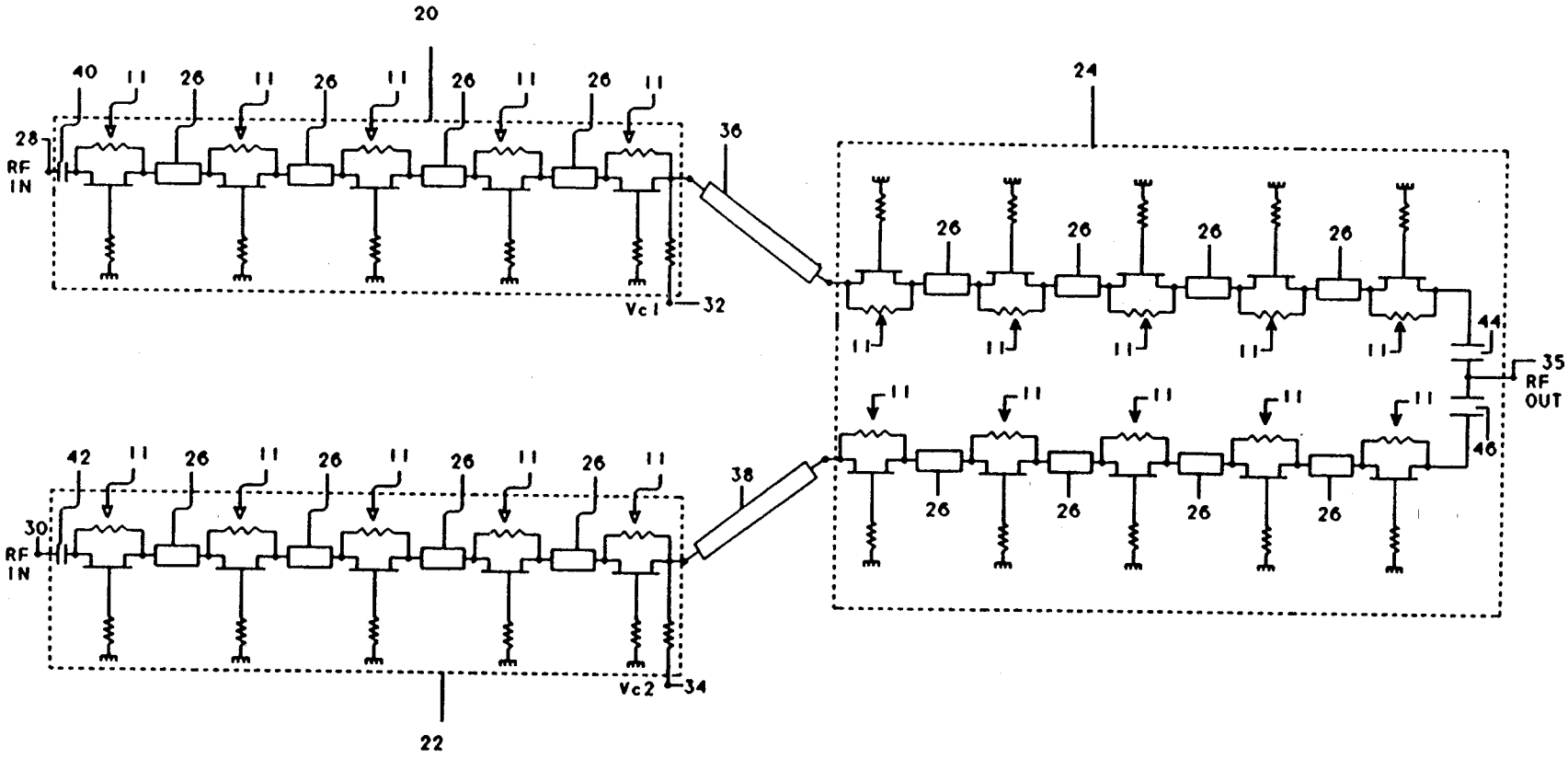
FIG. 6 is a schematic diagram of a switching circuit employing a plurality of switching modules, each module including a plurality of switching elements as shown in FIG. 5.

The FET 12 is turned ON or OFF by applying a bias voltage to the drain and source. In FIG. 5, the bias voltage $V_c$ is applied through a third resistor 18 to the drain and source. Again, the third resistor 18 provides voltage continuity, rather than a voltage drop. The resistor 18 is not necessarily a part of the switching element 11. In switching circuits in which a plurality of switching elements 11 are cascaded in series, as shown in FIG. 6, for example, one bias voltage source through one resistor (such as 18) suffices to provide a bias voltage to all of the switching elements 11, since DC continuity is established at the drains and sources of each of the cascaded FETs. The bias voltage alternatively is applied through an external inductor or other circuit, rather than a resistor 18. Also, resistor 18 has a finite resistance value, typically greater than 2000 ohms, to prevent RF shorting to a low impedance bias voltage source.

The bias voltage $V_c$ has two values, high and low, which respectively turn the switching element 11 OFF and ON. ON means that a low impedance high frequency pathway is established between the drain and source, and OFF means that the drain/source pathway is high impedance. If the low voltage is 0 volts, then all three of the terminals of the FET 12 are at the same potential, and the FET 12 is rendered conductive. If the high voltage is, for instance, +5 volts, then the drain and source are +5 volts, and the gate is at ground potential. The FET 12 is OFF, and the drain/source impedance is high. In either case, however, there is no need for a bias current such as was required for the PIN diode circuit. This is because the FET 12 is used as a voltage controlled resistor, not as a current controlled device.

It should be noted that, while a circuit employing switching elements as shown in FIG. 5 and discussed here provide high impedance under the conditions described here, there is a frequency beyond the useful performance bandwidth of the switch at which the switch becomes a band pass circuit in the OFF mode. This is due to stray capacitances at the ends of the transmission line segments and to capacitive loading caused by the FET.

A plurality of the basis switching elements 11 of FIG. 5 may be coupled in series to form a high frequency switching module. FIG. 6, for instance, is a schematic diagram of a switching device having three switching modules, each module including a plurality of the switching elements 11 of FIG. 5. There are first and second SPST modules 20, 22, and an SPDT module 24.

The SPST modules 20, 22 each include five of the switching elements 11 of FIG. 5. In each module 20 and 22, the elements are coupled in series with transmission line segments 26 in between drains and sources of adjacent elements. The switching elements and transmission line segments 26 are arranged linearly for end-to-end RF isolation. The modules 20, 22 have high frequency inputs 28 and 30, respectively, and bias voltage inputs 32 and 34. The bias voltages are as follows: For the module 20, a bias voltage of 0 v at the input 32 turns the circuit ON, and +5 v turns the circuit OFF. For the module 22, a bias voltage of +5 v at the input 34 turns the circuit OFF, and 0 v turns the circuit ON. In operation, one of the modules 20 and 22 is turned ON at a time. Both modules 20, 22 can be turned OFF.

The SPDT module 24 includes 10 switching elements 11 grouped into two sequences of five each, and a high frequency output 35. Additional transmission line segments 26 are coupled in between respective drains and sources of the two sequences of switching elements 11. The two sequences of switching elements 11 are coupled in series with the modules 20 and 22, respectively, through additional transmission line segments 36 and 38. The bias voltages received at the inputs 32 and 34 are also applied through the transmission line segments 36 and 38 to the drains and sources of the FETs in the two sequences in the module 24. Accordingly, in spite of the large number of switching elements 11 in the switch circuit of FIG. 6, only two low-current bias voltage inputs are employed, thus reducing the number of potential high frequency leakage pathways. Supplying suitable voltages at the bias voltage inputs 32 and 34 turns the entire modules 20 and 22, and the two sequences within the module 24, ON or OFF.

For each switching element 11, the isolation is frequency dependent, since the OFF impedance is actually a frequency-dependent capacitive reactance. Typically, over 1 to 2 GHz, the isolation is 10 to 20 dB per switching element 11. In general, the isolation of the overall switching circuit, expressed in dB, is related to the number of switching elements 11 coupled in series. The total isolation for a switching circuit as shown in FIG. 6 is about 120 dB over 0.5 GHz to 13 GHz, greater at the low end of the frequency band.

Capacitors 40, 42, 44, 46 are coupled in series with the switching elements 11 adjacent to the high frequency inputs 28, 30 and to the output 35, in the latter case one for each sequence. The capacitors 40–46 serve as DC blocks to prevent external components from shorting out the modules. While the three modules 20, 22, 24 in FIG. 6 may be fabricated separately and then coupled with the transmission line segments 36, 38, there preferably should not be capacitors such as 40–46 between the bias voltage sources 32, 34 and any of the switching elements 11. This is to provide DC continuity between the bias voltage inputs 32, 34 and the switching elements 11. In the overall circuit shown in FIG. 6, the bias voltage inputs 32, 34 may be coupled adjacent to any of the switching elements 11. In FIG. 6, the bias voltage inputs 32, 34 are inserted at about the mid-points of the sequences of switching elements 11 running from the input 28 to the output 35, and from the input 30 to the output 35, respectively. These positions keep the propagation pathways from the inputs 32, 34 through the switching elements 11 to the furthest switching elements 11 to a minimum, thereby shortening voltage propagation delay and minimizing control circuit voltage drop due to any parasitic leakage paths to ground.

The transmission lines 26, 36, and 38 are preferably rated at 50 Ohms. Experimentation has shown that the switching circuit works well if the transmission lines have lengths equal to about $\frac{1}{4}$ of a wavelength of a highest frequency to be carried.

Figure 7:
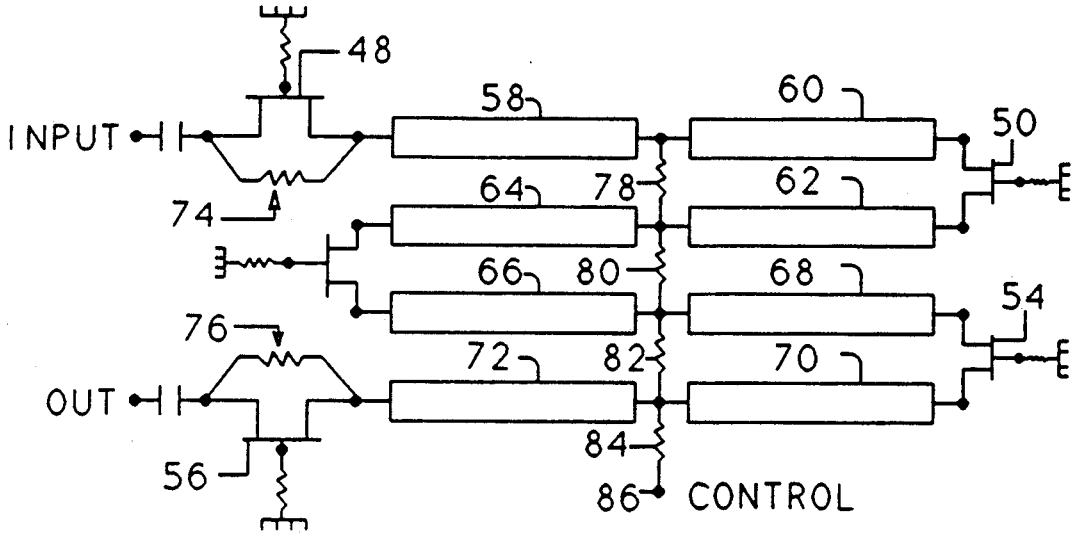
FIG. 7 is a schematic diagram showing a physical layout of a switching circuit according to a third embodiment of the invention.

FIG. 7 is a diagram of an all-stop configuration SPST switch comparable in function to one of the modules 20 and 22 of FIG. 6. The switch includes switching elements including FETs 48, 50, 52, 54, and 56, and transmission line segments 58, 60, 62, 64, 66, 68, 70, and 72 coupled between the drains and sources of the FETs. While the switching elements are shown in schematic form, the diagram also shows a physical layout of the transmission line segments coupled between the switching elements. Similarly to FIGS. 3 and 4, the transmission line segments are in a balanced position side-by-side to provide the advantageously compact solid state layout of the all-stop filter geometry.

The switching elements including the FETs 48 and 56 are essentially similar to that shown in FIG. 5, having high impedance resistors 74 and 76 coupled between their drains and sources. On the other hand, the FETs 50, 52, and 54 do not have resistors coupled directly between their drains and sources. Rather, the resistors are coupled at junctions between the transmission line segments. Essentially, each of the ¼ wavelength transmission line segments has been cut in half. Instead of a resistor coupled between the drain and source of the FET 50, there is a resistor 78 coupled between the junction between the segments 58 and 60 and the junction between the segments 62 and 64. Similar resistors 80 and 82 are also shown.

The resistors 78, 80, 82 are coupled to junctions between the transmission line segments in this manner because, at all frequencies, the mid-points of the transmission lines between the drains and sources of the FETs are high frequency voltage null points in the OFF state. As a consequence, there is low coupling between the transmission line junction points despite the resistors coupled therebetween. At DC and very low RF frequencies, however, the resistor path coupling increases up to that of a resistor string in a 50 Ohm system. The center resistor string allows high speed voltage biasing of the drains and sources of the FETs of the all-stop filter network through a bias resistor coupled between a control voltage input 86 and the center line resistor string.

As shown, the gates of all of the FETs 48, 50, 52, 54, and 56 are coupled to ground through resistors. These resistors provide bias voltage pathways for setting the gate voltages; in the steady state, they do not conduct current or carry voltage drops. Similarly, the drain and source bias voltages are established by applying a control voltage at the control input 86.

The FETs operate in a voltage-controlled resistor or voltage-controlled current source mode. The control voltage preferably varies between a low value, such as ground or a logic low level according to a suitable digital logic technology, and a high value, such as a logic high value in the logic technology. If the control voltage is low, the gate, drain, and source voltages are approximately equal. If the control voltage is high, the gate voltage is substantially lower than the drain and source voltages. Thus, in the former case the drain/-source resistance is low, and the switching element is thus turned ON. In the latter case the resistance is very high and the switching element is OFF, which brings about the high isolation all-stop condition.

Figure 8:
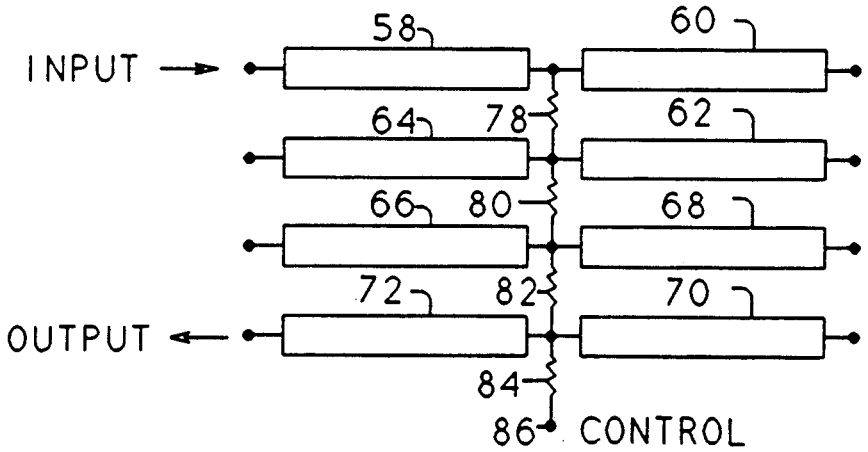
FIG. 8 is a schematic representation of the circuit of FIG. 7 in an OFF state.

FIG. 8 shows the switching circuit of FIG. 7 in an all-stop mode. Since the drain/source resistance is very high, the drain and source terminals are effectively opened. Thus, the transmission line segments 58–72 appear to be coupled only at the resistors 78, 80, 82. Since, as stated above, the points at which the resistors and transmission line segments are coupled are high signal frequency voltage nulls, the high isolation of the circuit according to the invention is preserved.

Figure 9:
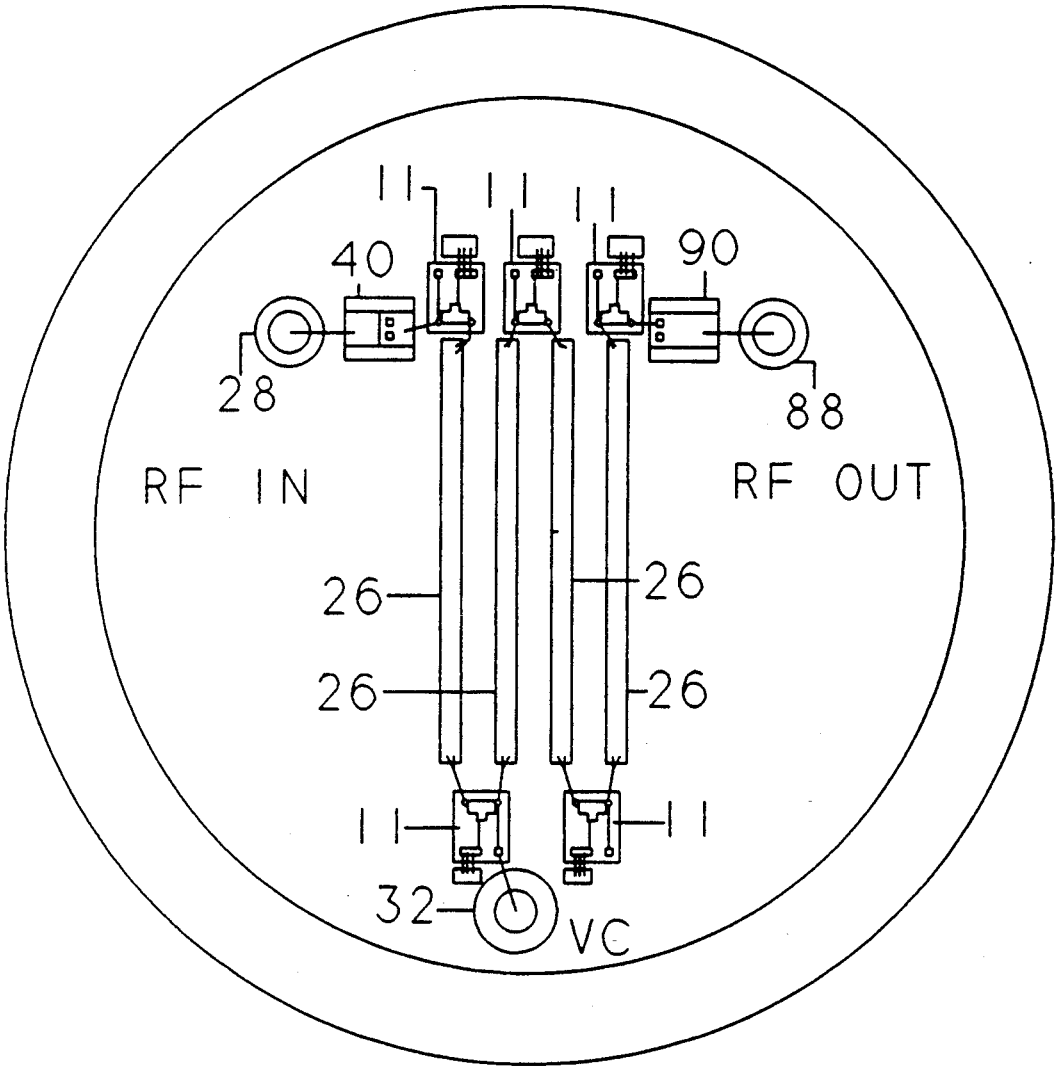
FIG. 9 is a diagram showing a physical layout of a single pole, single throw switch as shown in FIG. 6.

Turning to FIG. 9, there is shown a physical layout for a switching circuit such as the SPST module 20 of FIG. 6. The switching elements 11, the transmission lines 26, the high frequency input 28, and the capacitor 40 are numbered in FIG. 9 in accordance with comparable components in FIG. 6. In addition, a high frequency output 88 and a 50 ohm interconnected transmission line 90 are added to this stand-alone SPST switch.

It will be seen from FIG. 9 that the transmission line segments 26 are laid out side-by-side and parallel, to form a balanced serpentine pathway for the high frequency signal from the input 28 to the output 88. This layout is similar to that of the PIN diode circuits of FIGS. 3 and 4, in which high OFF isolation is obtained in a compact network by the use of the all-stop transmission line configuration. Accordingly, the invention makes possible advantageous compactness of layout and packaging, for circuits employing PIN diodes or FETs as switching elements.

In the ON mode, the objective of the circuit is to carry the high frequency signal with minor attenuation, so high line-to-line isolation is not a major concern. In practice, the lines are spaced apart using standard layout principles for low isolation circuits. In this example, 50 ohm lines on Er=10 dielectric stripes are spaced apart by air with gaps approximately 1.5 times the line width.

In the OFF mode, however, the objective of the circuit is to isolate the output from the high frequency signal at the input. When OFF, the balanced transmission configuration is effectively an "all-stop" filter structure in which the adjacent transmission line segments are effectively decoupled.

Figure 10:
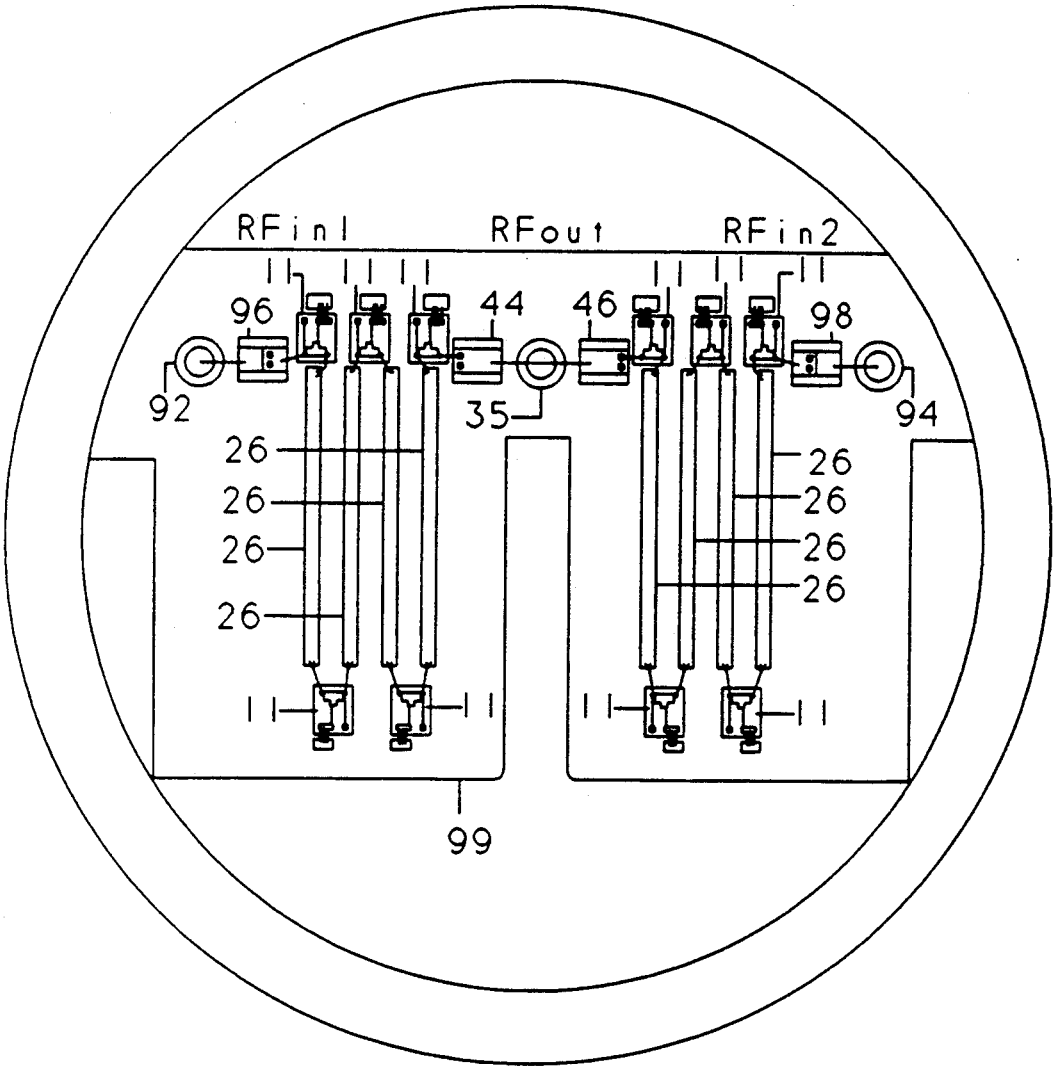
FIG. 10 is a diagram showing a physical layout of a single pole, double throw switch as shown in FIG. 6.

FIG. 10 shows a physical layout for an SPDT module similar to the module 24 of FIG. 6, including high frequency inputs 92 and 94 which are coupled, respectively, through short 50 ohm transmission line segments 96 and 98 to components numbered similarly to those in the module 24 of FIG. 6. These components make up two sections, i.e., halves, coupled between the respective inputs 92 and 94 and a common output 35. In operation, only one of the sections is ON at a time, and both may be OFF.

The two halves of the switching circuit are in a folded, balanced serpentine geometry, which gives the all-stop filter high isolation performance when the switching elements 11 are OFF. Additionally, FIG. 10 shows an internal conductive wall 99 positioned between the circuit halves for RF radiation capacitive coupling isolation. The packaging for the circuit includes a conductive cover (not shown) for further isolating the two circuit halves, except in the area around the common output port 35.

Figure 12:
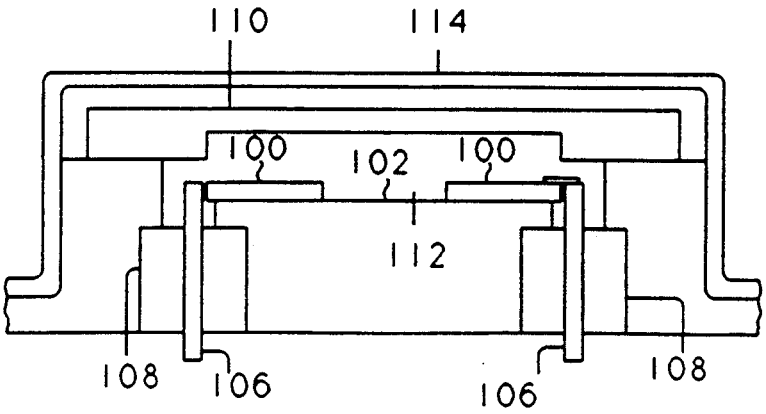
FIG. 12 is a side view of the physical layout of switches, a top view of which is shown in FIG. 11.
Figure 11:
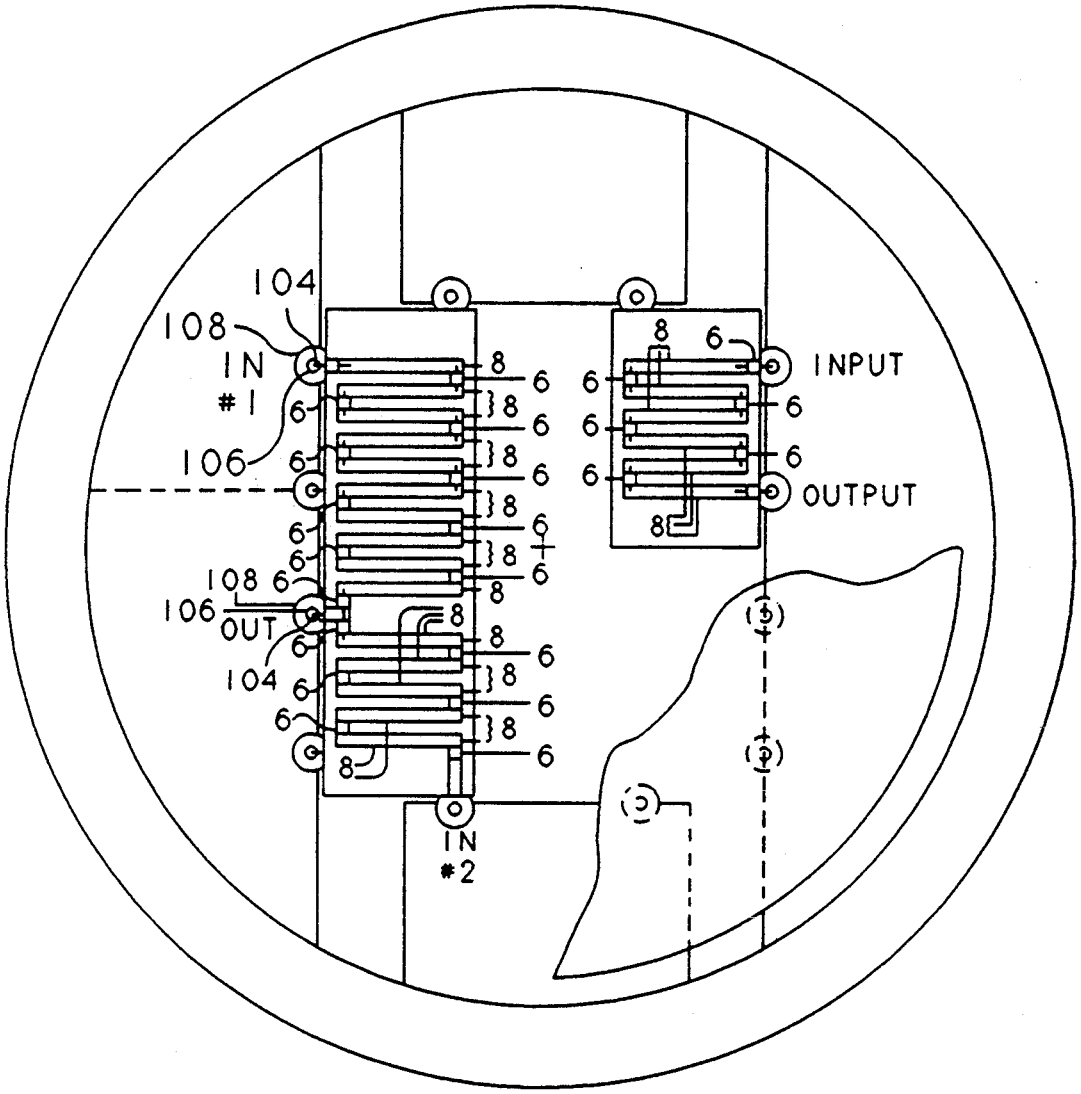
FIG. 11 is a top view of a physical layout of switches according to the first embodiment of the invention.

FIGS. 11 and 12 are top and side views, respectively, of a beam lead type PIN diode compact switching circuit layout, including its packaging, for the SPST switch of FIG. 3, and a similar SPDT switch. Components similar to those of FIG. 3 are numbered similarly. In FIG. 11, the transmission line segments 8, the switching elements 6, etc., are disposed on substrates 100, preferably alumina microstrip substrates. The substrates 100 are mounted on a hermetically sealed header base 102, preferably made of Kovar. Wire bonds 104 couple the switch circuit layout to pins 106, preferably made of gold plated Kovar. The pins 106 are surrounded by insulating members 108, preferably made of glass. A conductive substrate cover 110, for improving electrical isolation, shown in a partially cutaway view, covers the substrates 100, etc.

FIG. 12 is a cutaway side view of the structure of FIG. 11. Most of the elements numbered in FIG. 11 and discussed above are visible. In addition, an RF cavity 112 is defined by the substrates 100, the header 102, and the substrate cover 110. When the switching circuit is in the OFF mode, i.e., when the switch is open, the cover 110 minimizes direct input-to-output RF leakage. Finally, a cover 114 such as a hermetic cover encloses the above-discussed components of the device to protect them from environmental damage.

Figure 13:
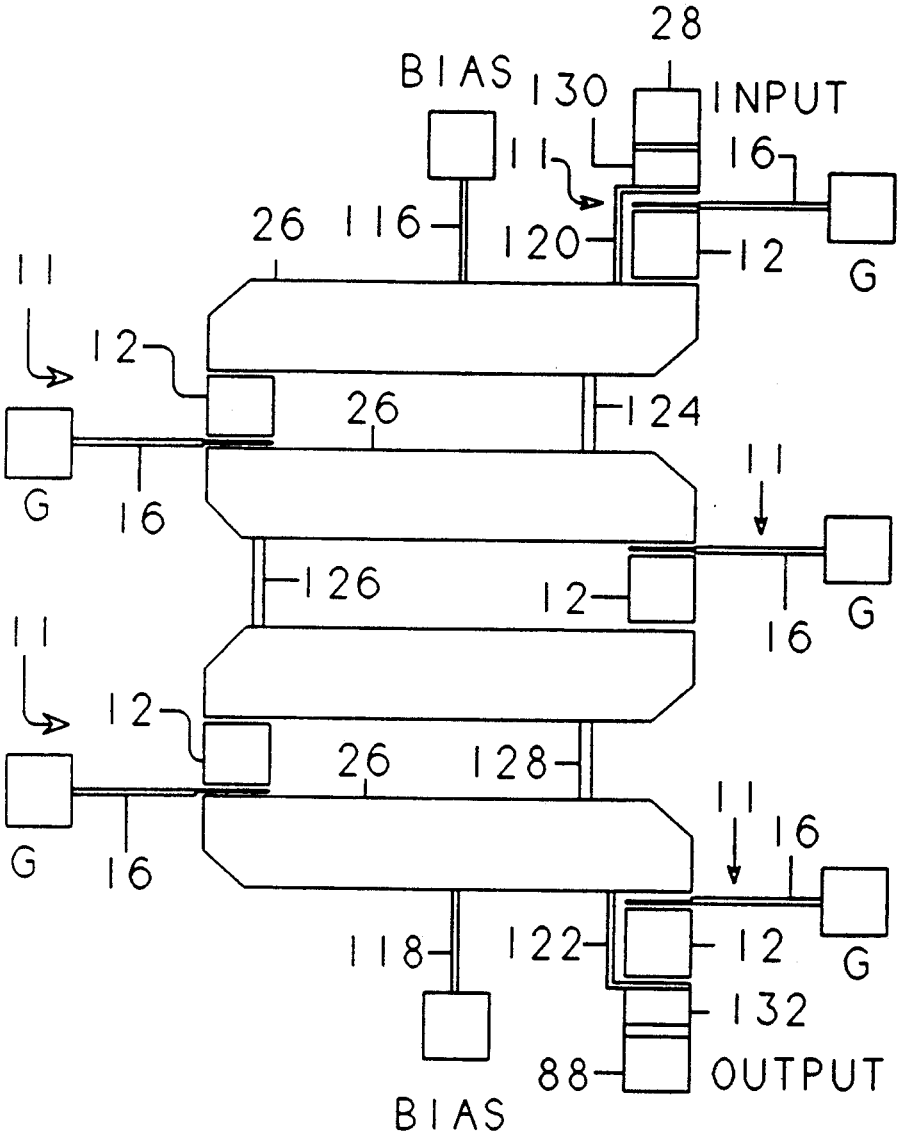
FIG. 13 is a detailed physical layout of a single pole, single throw switch according to a fourth embodiment of the invention.

FIG. 13 is a detailed diagram showing the geometry of a preferred layout for a monolithic integrated circuit SPST switching circuit similar in most respects to that shown in hybrid microcircuit form in FIG. 9. Comparable components, such as the switching elements 11 including the FETs 12, the gate-to-ground resistors 16, etc., are numbered consistently. The transmission lines 26 have lengths, preferably approximately ¼ of the shortest wavelength to be propagated by the switching circuit, and widths suitable for providing 50 ohm characteristic impedance. The transmission lines 26 are substantially rectangular in shape, although they may have rounded or beveled outside corners, as shown. Switching elements including FETs, etc., are positioned between ends of adjacent transmission lines. The spacing between adjacent transmission lines is related to the dimensions of the switching elements. However, the adjacent transmission lines are spaced sufficiently far apart to avoid the production of objectionable destructive coupling when in the ON mode. For a GaAs substrate MMIC, this spacing minimum is approximately equal to the transmission line width. On the other hand, the adjacent transmission line segments are close enough together that a bridge between the adjacent segments, such as a resistor, is not long enough for a noticeable phase difference to appear across it.

The circuit of FIG. 13 differs from that of FIG. 9 in two respects. First, instead of a single bias voltage source through a single bias resistor, two bias resistors 116 and 118 are shown, coupling a bias voltage into the circuit at two different points. Also, the bias resistors are coupled to points on the transmission lines 26, rather than at junctions between the switching elements 11 and the transmission lines 26.

Second, instead of having a resistor 14 coupled directly between the drain and source of each FET 12, the circuit of FIG. 13 has resistors 120 and 122 coupled between the drains and sources of corresponding FETs adjacent to the input 28 and the output 88, and coupling circuits shown as additional resistors 124, 126, and 128 coupled across gaps between the transmission lines 26 at ends of the transmission lines 26 opposite to ends at which the FETs 12 are coupled. In the appended claims, the resistors 124, 126, and 128 are recited as coupling circuits.

A high isolation narrow-band null is achieved with each of these resistors. Positioning the resistors in staggered locations along the respective transmission lines enables the overall circuit to produce an overall bandwidth of very high isolation. This is because, at positions other than the midpoints of the transmission line segments at which nulls occur, there will be phase differences between the signals on the transmission line segments.

The resistors 124, 126, and 128 are designed to provide some important signal isolation improvement at the high end of the useful bandwidth when in the OFF state. By proper selection of resistor values and location, a shunt path out-of-phase signal is added between parallel transmission lines as feedback to reduce signal leakage through an associated FET in the OFF state. This arrangement improves high end isolation, while degrading low frequency isolation. However, the overall minimum isolation is improved. Modeling has shown that 400 Ohm shunt resistors gives improved switch performance.

Figure 14:
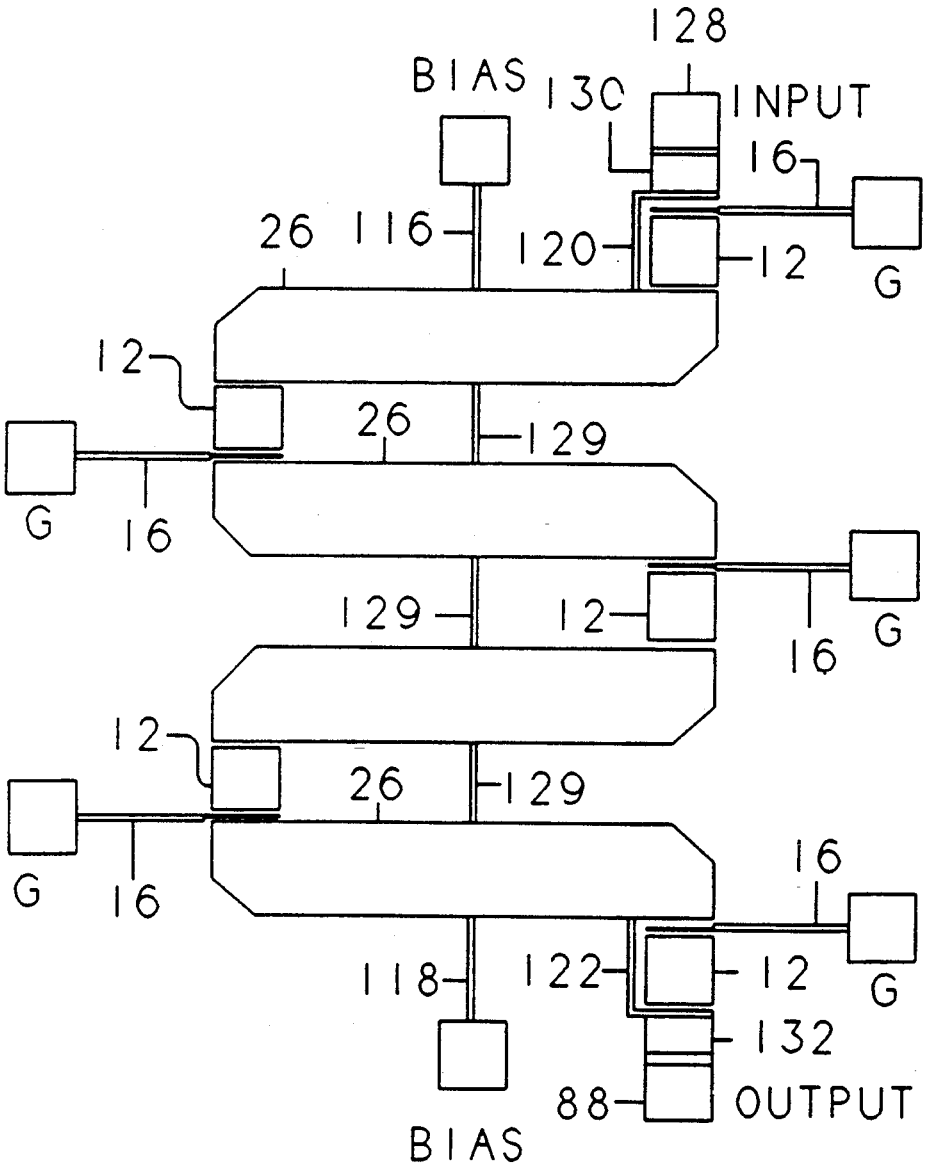
FIG. 14 is a detailed physical layout of a single pole, single throw switch according to a fifth embodiment of the invention.

FIG. 14 is a detailed circuit layout diagram essentially similar in form to that of FIG. 13. The circuit shown in FIG. 14, however, more closely resembles that of FIG. 7, which has resistors 129 placed at midpoints of the transmission lines running between the drains and sources of the FETs to provide DC biasing of the drains and sources of the FETs with little RF effect to the basic switch function.

In the layouts shown in FIGS. 13 and 14, the active substrate upon which the illustrated components are laid out are preferably a semi-insulating substance which is made thick, since there is no need for low inductance grounding vias and the circuit is inherently an ALL-STOP filter structure. A thickness of 0.020" has been used for operation over a frequency range of 0 to 40 GHz. Conventionally, a 40 GHz MMIC switch such as those of FIGS. 1 and 2 is built on a 0.005" thick GaAs MMIC substrate for low impedance grounding.

Such a thick substrate also minimizes shunt stray capacitances caused by using large FETs having low ON series resistances. The illustrated layouts facilitate cascading with similar circuits. Signal input/output bonding pads and control bias voltage pads line up for direct chip-to-chip bonding. DC blocking capacitors (shown as 130 and 132) prevent shorting the high impedance control voltage network. Wire bonds at the gate-to-ground resistors 16 on the metal die bonding surface are minimized by tying the resistors 16 together on each side of the die, although additional decoupling may be used to compensate for reduced isolation. Alternatively, ground lands on the die are ground vias built into the substrate.

Preferably, one or a cascaded plurality of circuits should be placed in a package with narrow walls and a low cover to prevent wave propagation around the chip. The illustrated circuits may be combined together to provide different types of switches. For instance, combining two of the circuits of FIG. 14 produces a three port SPDT switch. As shown in FIG. 6, such a resulting SPDT switch is controlled from a remote SPST switch to make up a distributed SPDT switch for very high isolation matrix switch applications To facilitate remote control, the DC blocking capacitor preferably is removed or shorted. Finally, a circuit as shown in FIG. 14 may be used as a broad bandwidth variable attenuator when biased up from the minimum resistance OFF state.

The basic all-stop circuit layout configuration with semiconductor devices connecting the ends, as shown in FIG. 14, is also used to design very broad bandwidth, very compact monolithic varactor tuned filters of the capacitive end gap coupled ½ wavelength resonator type.

The invention has been described in terms of the preferred embodiments shown and described above. However, the embodiments are intended to be exemplary, not exhaustive are restrictive of the invention. Those equivalents, variations, etc., which would be obvious to a person of ordinary skill in the art are deemed to fall within the spirit and scope of the invention.

What is claimed is:

1. A high frequency switch circuit element comprising:

a voltage controlled resistor in the form of a field effect transistor having a gate coupled to a reference voltage terminal, a source, and a drain;

an input terminal to which a high frequency signal is applied, said input terminal being coupled to one of the source and drain of said field effect transistor;

an output terminal from which said high frequency signal is derived, said output terminal being coupled to the other of the source and drain of said field effect transistor;

a control terminal to which a control signal is applied, coupled to said field effect transistor, for controlling the operation of said switch circuit element, said control signal having a first state which places said field effect transistor in a first, low impedance state between the source and drain thereof, so as to effectively provide a high frequency signal pathway between said source and drain and thereby between said input terminal and said output terminal, and wherein said control signal has a second state which places said field effect transistor in a second, high impedance state, so as to effectively isolate said source and drain and thereby said input terminal from said output terminal, and thereby prevent said high frequency signal pathway from being established between from said input terminal through said field effect transistor said output terminal;

a first resistor coupled between said input terminal and said output terminal, so as to effectively bridge the source and drain of said field effect transistor; and further including a second resistor coupled between said gate and said reference voltage terminal, and wherein said reference voltage terminal is coupled to ground.

2. A high frequency switch circuit element according to claim 1, further comprising a third resistor coupled between said control terminal and said one of the source and drain of said field effect transistor.

3. A high frequency switching device comprising:

a plurality of high frequency switch circuit elements having respective input and output terminals coupled in cascade between an input port and an output port, each high frequency switch circuit element being formed of a voltage controlled resistor in the form of a field effect transistor having a gate coupled to a reference voltage terminal, a source, and a drain, an input terminal to which a high frequency signal is applied, said input terminal being coupled to one of the source and drain of said field effect transistor, an output terminal from which said high frequency signal is derived, said output terminal being coupled to the other of the source and drain of said field effect transistor, and a first resistor coupled between said input terminal and said output terminal, so as to effectively bridge the source and drain of said field effect transistor; and a control terminal, to which a control signal is applied, coupled to a field effect transistor of one of the cascaded high frequency switch circuit elements, for controlling the operation of said cascaded high frequency switch circuit elements, said control signal having a first state which places each field effect transistor in a first, low impedance state between the source and drain thereof, so as to effectively provide a high frequency signal pathway between the sources and drains thereof, and wherein said control signal has a second state which places said field effect transistors in a second, high impedance state, so as to effectively isolate the sources and drains thereof, and thereby prevent a high frequency signal pathway from being established from said input port to said output port.

4. A high frequency switching device according to claim 3, wherein each cascaded field effect transistor includes a second resistor coupled between its gate and said reference voltage terminal.

5. A high frequency switching device element according to claim 4, further comprising a third resistor coupled between said control terminal and said one of the source and drain of said one of said cascaded high frequency switch circuit elements.

6. A high isolation switch circuit module comprising:

an input port and an output port;

a plurality of generally linear transmission line segments of equal length disposed in parallel, spaced apart relationship with one another, each transmission line segment having first and second ends which are disposed adjacent to respective first and second ends of an adjacent transmission line segment, such that a line which is orthogonal to and bisects one of said plurality of transmission line segments also bisects the other transmission line segments of said plurality of transmission line segments, and wherein one end of a first of said transmission line segments is coupled to said input port and wherein one end of a second of said transmission line segments is coupled to said output port;

a plurality of controllable impedance switching elements, respective ones of which are coupled between alternate adjacent ends of adjacent ones of said segments, so as to form a serpentine pattern of transmission line segments of controllable impedance switching elements, and such that with each of said controllable impedance switching elements being in an effectively electrically open, high impedance state, each of said transmission line segments is effectively electrically isolated from every other transmission line segment and said output port is effectively electrically isolated from said input port, thereby providing an all-stop configuration, and such that with each of said controllable impedance switching elements being in an effectively electrically closed, low impedance state, said transmission line segments are effectively electrically connected in series, and said output port is effectively electrically coupled to said input port, thereby providing an all-pass configuration.

7. A high isolation switch circuit module according to claim 6, wherein each of said controllable impedance switching elements comprises a PIN diode having its anode and cathode coupled between adjacent ends of adjacent ones of said transmission line segments.

8. A high isolation switch circuit module according to claim 6, wherein each of said controllable impedance switching elements comprises a high frequency switch circuit element that includes a voltage controlled resistor in the form of a field effect transistor having a gate coupled to a reference voltage terminal, a source coupled to an end of one of said transmission line segments, and a drain coupled to an adjacent end of an adjacent one of said transmission line segments.

9. A high isolation switch circuit module according to claim 8, further including a first additional controllable impedance switching element in the form of a voltage controlled resistor comprised of a field effect transistor having a gate coupled to a reference voltage terminal, its source and drain coupled between said one end of said first of said transmission line segments and said input port, and a first resistor coupled between the source and drain of said first field effect transistor, and a second additional controllable impedance switching element in the form of a voltage controlled resistor comprised of a field effect transistor having a gate coupled to a reference voltage terminal, and its source and drain coupled between said one of said second of said transmission line segments and said output port, and a second resistor coupled between the source and drain of said second field effect transistor.

10. A high isolation switch circuit module according to claim 9, further including a control terminal to which a control signal is applied, coupled to each of said transmission line segments, for controlling the operation of said switch circuit module, said control signal having a first state which places the voltage controlled resistor field effect transistors in a first, low impedance state between the sources and drains thereof, so as to effectively provide a high frequency signal pathway through a series coupling of said plurality of transmission line segments, and wherein said control signal has a second state which places said voltage controlled resistor field effect transistors in a second, high impedance state, so as to effectively electrically isolate said transmission line segments from one another.

11. A high isolation switch circuit module according to claim 10, further including a plurality of resistors respectively ones of which bridge prescribed locations of adjacent transmission line segments and wherein said control terminal is coupled to a selected location of at least of one of said transmission line segments.

12. A high isolation switch circuit module according to claim 11, wherein said prescribed locations of adjacent transmission line segments are high frequency voltage null points.

13. A high isolation switch circuit module according to claim 11, wherein said prescribed locations of adjacent transmission line segments are midpoints thereof.

14. A high isolation switch circuit module according to claim 13, wherein said selected location is a midpoint of said at least of one of said transmission line segments.

* * * * *